US006271527B1

(12) United States Patent
Chutjian et al.

(10) Patent No.: US 6,271,527 B1
(45) Date of Patent: Aug. 7, 2001

(54) HIGH-EFFICIENCY ELECTRON IONIZER FOR A MASS SPECTROMETER ARRAY

(75) Inventors: Ara Chutjian, La Crescenta; Murray R. Darrach, Arcadia; Otto J. Orient, Glendale, all of CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/588,991

(22) Filed: Jun. 6, 2000

Related U.S. Application Data

(63) Continuation of application No. 09/165,176, filed on Oct. 1, 1998, now Pat. No. 6,072,182.
(60) Provisional application No. 60/060,895, filed on Oct. 3, 1997.

(51) Int. Cl.[7] ..... H01J 49/14
(52) U.S. Cl. ..... 250/427; 250/423 R; 250/288
(58) Field of Search ..... 250/427, 423 R, 250/288

(56) References Cited

U.S. PATENT DOCUMENTS

| | | | | |
|---|---|---|---|---|
| 3,247,373 | * | 4/1966 | Herzog et al. | 250/427 |
| 4,313,911 | * | 2/1982 | Moran et al. | 250/427 |
| 4,943,718 | * | 7/1990 | Haines et al. | 250/427 |
| 5,756,996 | * | 5/1998 | Bier et al. | 250/427 |
| 6,072,182 | * | 6/2000 | Chutjian et al. | 250/427 |

* cited by examiner

*Primary Examiner*—Kiet T. Nguyen
(74) *Attorney, Agent, or Firm*—Fish & Richardson P.C.

(57) ABSTRACT

The present invention provides an improved electron ionizer for use in a quadrupole mass spectrometer. The improved electron ionizer includes a repeller plate that ejects sample atoms or molecules, an ionizer chamber, a cathode that emits an electron beam into the ionizer chamber, an exit opening for excess electrons to escape, at least one shim plate to collimate said electron beam, extraction apertures, and a plurality of lens elements for focusing the extracted ions onto entrance apertures.

4 Claims, 4 Drawing Sheets

HIGH-EFFICIENCY ELECTRON IONIZER FOR A MASS SPECTROMETER ARRAY

CROSS-REFERENCE TO RELATED APPLICATIONS

This is a continuation of U.S. application Ser. No. 09/165,176, filed Oct. 1, 1988, now U.S. Pat. No. 6,072,182.

This application claims benefit of the priority of U.S. Provisional Application Ser. No. 60/060,895, filed Oct. 3, 1997 and entitled "High-Efficiency Electron Ionizer for a Mass Spectrometer Array."

ORIGIN OF INVENTION

The invention described herein was made in performance of work under a NASA contract, and is subject to the provisions of Public Law 96-517 (35 U.S.C. 202) in which the Contractor has elected to retain title.

TECHNICAL FIELD

The invention relates to an improved electron ionizer for a mass spectrometer array for the separation of ions with different masses.

BACKGROUND

A quadrupole mass spectrometer separates ions with different masses by applying a DC voltage and an rf voltage on four rods having circular or hyperbolic cross sections and an axis equidistant from each rod. Sample ions enter this cross sectional area through an aperture at the ends of the rods. The variation of the applied rf voltages on the four rods selects sample ions of a certain mass-to-charge ratio (m/e) to exit the quadrupole mass spectrometer to be detected. Sample ions with different m/e values either impact the rods and are neutralized or deflected away from the axis of the quadrupole.

A miniature quadrupole mass spectrometer array is described in U.S. Pat. No. 5,596,193, the disclosure of which is herein incorporated by reference.

FIG. 1 shows a block diagram of a typical prior art quadrupole mass spectrometer 100 constructed of 16-rod electrodes 106 in a 4×4 array to form nine separate quadrupole regions. Ionization of a gas sample begins in an ionizer chamber within an ionizer 102. Sample atoms or molecules are injected into this chamber where they are intercepted by electron beams and are ionized to positive ions. These are then extracted through the entrance apertures 104 of the quadrupole mass spectrometer 100 and are detected.

Electron ionizers, as used in mass spectrometers, have applications in environmental monitoring, semiconductor etching, residual gas analysis in laboratory vacuum chambers, monitoring of manufacturing plants against toxic substances, protection of buildings, harbors, embassies, airports, military sites, and power plants against terrorist attacks.

SUMMARY

The inventors noticed that the existing electron ionizers are relatively inefficient. They found that the electron beams are not passing to a proper area, near enough to the entrance apertures 104. Hence, those apertures are "starved" for ions. Proportionately more electrons escape out the exit than are extracted as ions through the entrance apertures 104. Even those apertures that have coverage lack efficient ion transport means to optimally focus ions onto the quadrupolar regions.

The system disclosed herein meets these drawbacks by using an electron beam collimator, preferably, at least one shim plate 310, to collimate an electron beam 306 emitted from a cathode 302. The electron beam intercepts sample atoms and molecules ejected from a repeller plate 312 and ionizes them to positive ions. The ions are then extracted by static fields formed by a repeller plate 312 and a first lens element 316. Three lens elements 316, 408 and 410 extract and focus these ions onto entrance apertures 412.

BRIEF DESCRIPTION OF THE DRAWINGS

Like reference numbers and designations in the various drawings indicate like elements.

DETAILED DESCRIPTION

Figure 1:
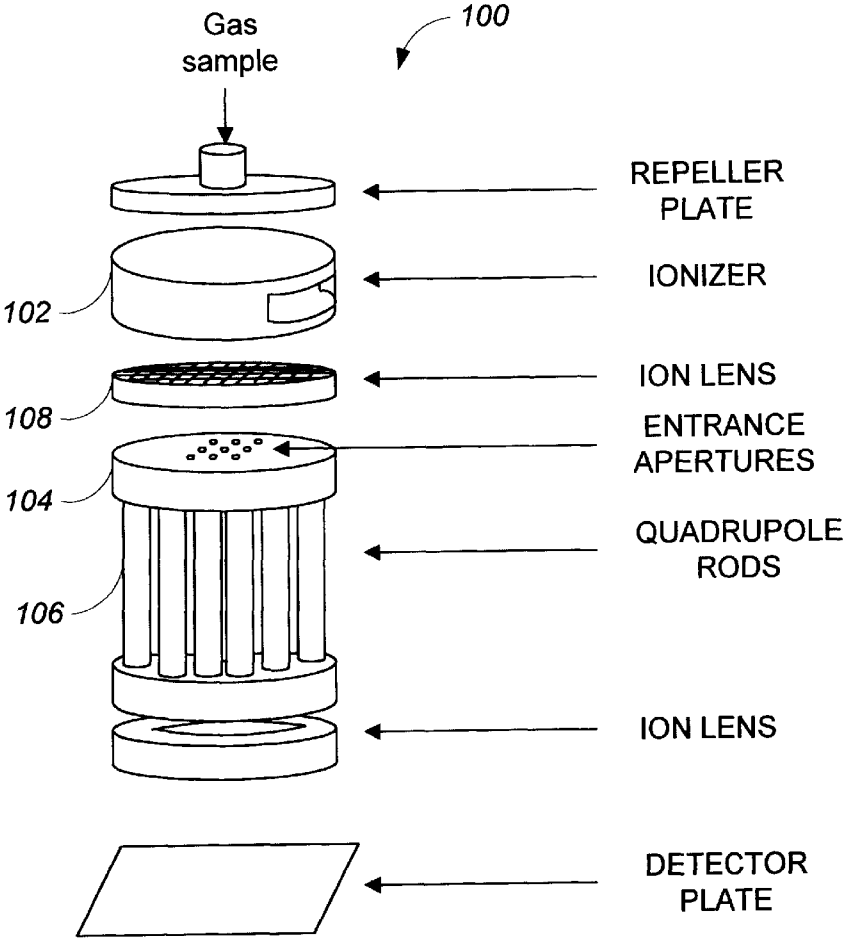
FIG. 1 (PRIOR ART)
FIG. 1 is a block diagram of a typical prior art quadrupole mass spectrometer constructed of 16-rod electrodes in a 4×4 array to form nine separate quadrupole regions.
Figure 2B:
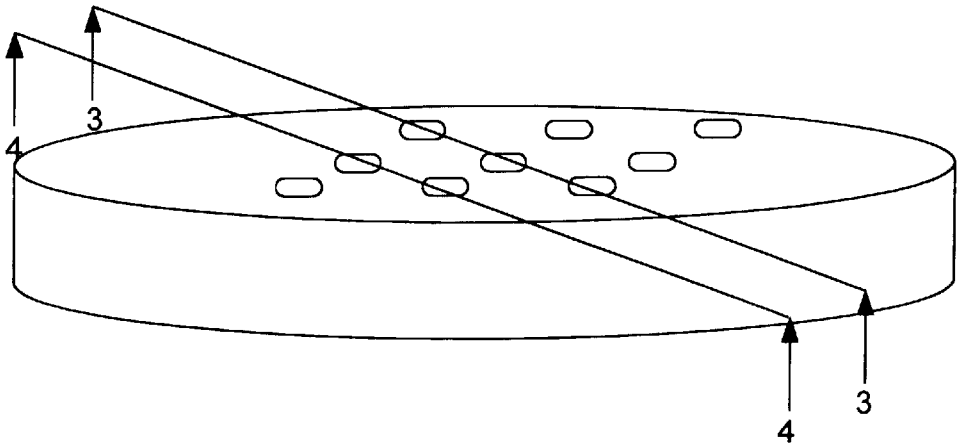
FIGS. 2A and 2B are block diagrams of an improved electron ionizer with a direction of cross-sectional views of FIGS. 3 and 4 shown.
Figure 2A:
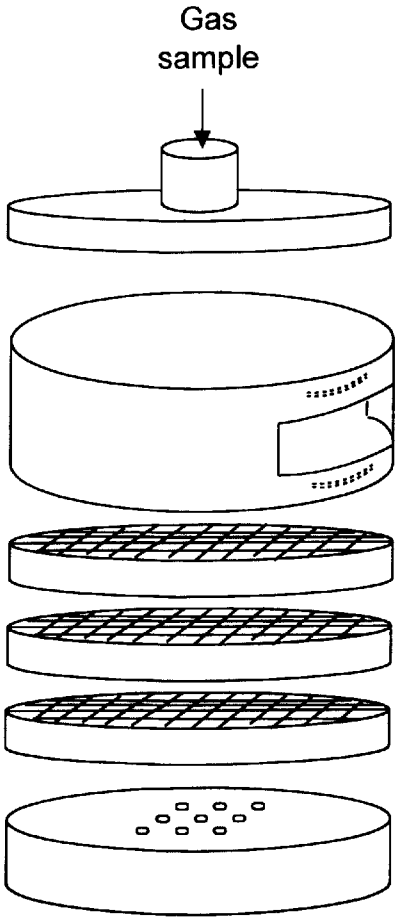
Figure 3:
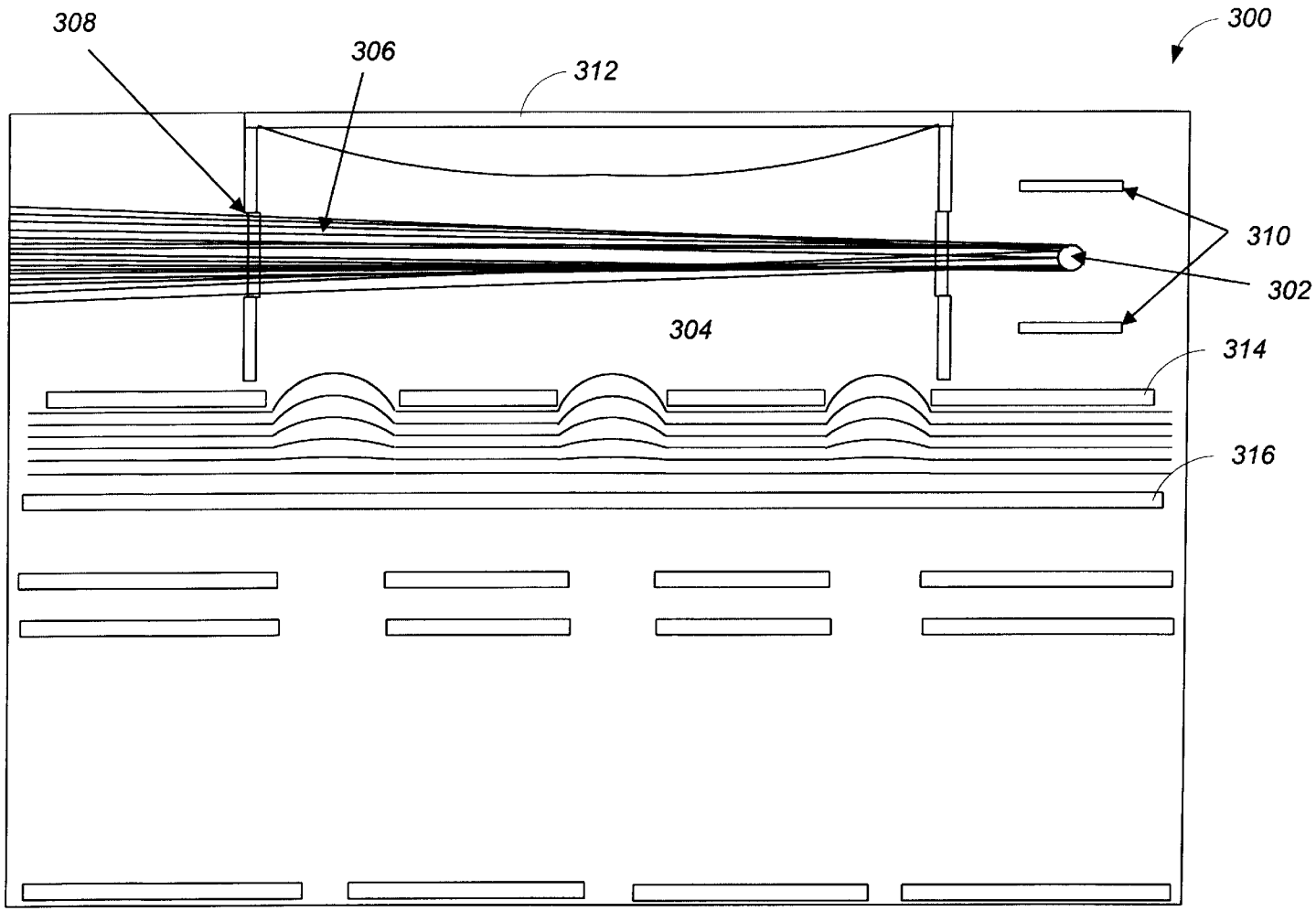
FIG. 3 is a cross-sectional view of an improved electron ionizer.
Figure 4:
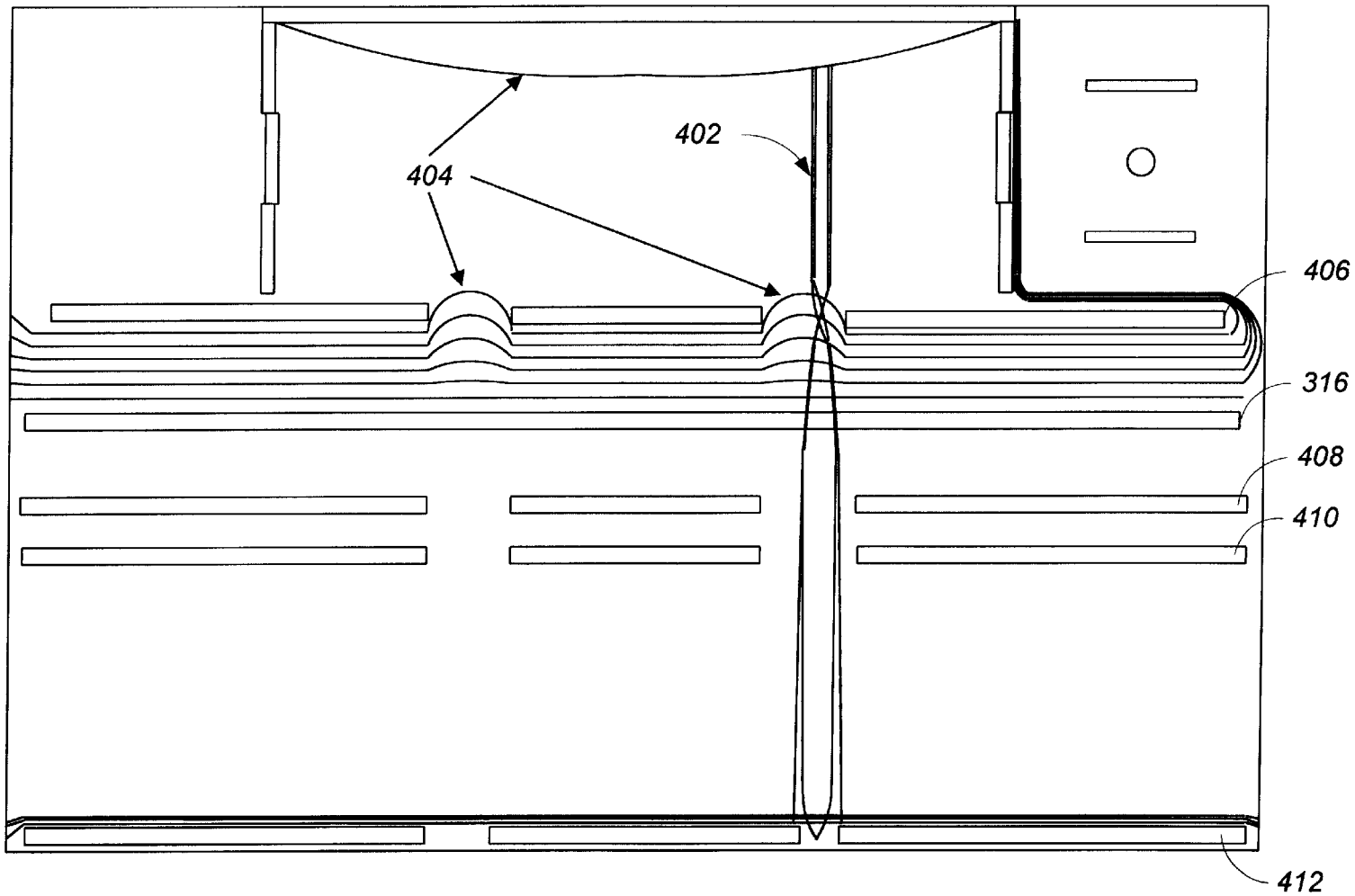
FIG. 4 is a different cross-sectional view of an improved electron ionizer with edge apertures shown.

The present disclosure describes an improved electron ionizer for use in a quadrupole mass spectrometer array. A diagram of an improved electron ionizer is shown in FIG. 2A with directions of cross-sectional views of FIGS. 3 and 4 shown in FIG. 2B. An improved electron ionizer 300, shown in FIG. 3, includes a repeller plate 312, an ionizer chamber 304, a cathode 302 that emits an electron beam 306 into the ionizer chamber 304, an exit opening 308 allowing for excess electrons to escape, at least one shim plate 310, extraction apertures 314, and a plurality of lens elements 316, 408 and 410 for focusing the extracted ions onto entrance apertures 412.

The cathode 302 is formed from a straight wire perpendicular to the plane of FIG. 3. The cathode 302 is biased at approximately −70 V relative to the ground. The cathode 302 emits an electron beam 306 into the ionizer chamber 304. Excess electrons not extracted as ions then exit through the opening 308 at the left end of the ionizer chamber 304. Typical emission currents used by the cathode 302 are 300 to 1000 $\mu$A. In a preferred mode, the cathode 302 uses an emission current of 500 $\mu$A. The electron beam 306 emitted from the cathode 302 is collimated by at least one shim plate 310. The at least one shim plate 310 is biased at approximately −100 V. In preferred embodiments, two shim plates 310 are provided. However, any device that focuses or collimates the electron beam toward the openings could be alternately used.

A repeller plate 312 ejects sample atoms and molecules toward grounded extraction apertures 314 filling the ionizer chamber 304. The electron beam 306 intercepts sample atoms and molecules and ionizes them to positive ions. The ions are then extracted by static fields which are set up by the geometry and potential of the repeller plate 312, and a first lens element 316. The repeller plate 312 is biased at approximately +2 V while the first lens element 316 is biased at approximately −8 V. Hence the beam is collimated to the right spot and the ions are pushed through the opening.

FIG. 4 shows trajectories of the positive ions 402 that are formed by the electron beam 306 and extracted by the static fields 404. A slightly different cross-section than FIG. 3 is taken to illustrate typical extraction difficulties experienced by edge extraction apertures 406. Also, the electron beam 306 is omitted for clarity. Appropriate geometry and potential of the repeller plate 312 and the first lens element 316 allow electron beam 306 to form ions above these edge extraction apertures 406. Lens elements 316, 408 and 410 then extract and focus these ions onto entrance apertures 412. A second lens element 408 is biased at approximately −25 V and placed at approximately 1 mm from the first lens element 316. A third lens element 410 is biased at approximately −200 V and placed at approximately 1 mm from the second lens element 408.

A number of embodiments of the present invention have been described. Nevertheless, it will be understood that various modifications may be made without departing from the spirit and scope of the invention. For example, while the invention has been described in terms of nine extraction apertures with cross-sectional figures showing two and three extraction apertures, the invention may be implemented with any number of extraction apertures. Also, while the invention has been described in terms of three lens elements, it may be implemented with any number of lens elements. Accordingly, other embodiments are within the scope of the following claims.

What is claimed is:

1. A method for ionizing sample molecules in a mass spectrometer, comprising:

emitting an electron beam into an ionizer chamber;

collimating the electron beam near extraction apertures;

repelling said sample molecules toward said extraction apertures, where the electron beam intercepts said sample molecules and ionizes the sample molecules into ions;

providing a plurality of lens elements to focus extracted ions into said extraction apertures; and detecting said ions.

2. The method of claim 1, wherein said emitting said electron beam includes providing a cathode to emit electrons.

3. The method of claim 1, wherein said collimating the electron beam includes providing at least one shim plate near the cathode to focus the electron beam.

4. The method of claim 1, wherein said repelling said sample molecules includes generating static fields to eject the sample molecules.

* * * * *